US010544486B2

(12) United States Patent
Kang et al.

(10) Patent No.: US 10,544,486 B2
(45) Date of Patent: Jan. 28, 2020

(54) NICKEL ALLOYS FOR EXHAUST SYSTEM COMPONENTS

(71) Applicant: HYUNDAI MOTOR COMPANY, Seoul (KR)

(72) Inventors: Min Woo Kang, Incheon (KR); Sung Chul Cha, Seoul (KR); Joong Kil Choe, Samcheok-si (KR)

(73) Assignee: HYUNDAI MOTOR COMPANY, Seoul (KR)

( * ) Notice: Subject to any disclaimer, the term of this patent is extended or adjusted under 35 U.S.C. 154(b) by 386 days.

(21) Appl. No.: 15/376,178

(22) Filed: Dec. 12, 2016

(65) Prior Publication Data

US 2018/0100217 A1 Apr. 12, 2018

(30) Foreign Application Priority Data

Oct. 12, 2016 (KR) ..... 10-2016-0131804

(51) Int. Cl.
*C22C 19/05* (2006.01)
*F01L 3/02* (2006.01)

(52) U.S. Cl.
CPC ..... *C22C 19/057* (2013.01); *C22C 19/055* (2013.01); *C22C 19/056* (2013.01); *F01L 3/02* (2013.01); *F01N 2530/02* (2013.01)

(58) Field of Classification Search
CPC ..... C22C 19/03; C22C 19/05; C22C 19/051; C22C 19/057; C22C 19/055; C22C 19/056; F01L 3/02
See application file for complete search history.

(56) References Cited

U.S. PATENT DOCUMENTS 6,752,883 B2 6/2004 Ishida et al.
6,918,972 B2 * 7/2005 Ueta ..... C22C 19/055 148/428
8,313,591 B2 11/2012 Hirata et al.
(Continued)

FOREIGN PATENT DOCUMENTS

EP 1340825 B1 9/2003
JP 2002003970 A 1/2002
(Continued)

OTHER PUBLICATIONS

Bhadeshia "Nickel Based Superalloys". University of Cambridge. http://www.phase-trans.msm.cam.ac.uk/2003/Superalloys/superalloys.html. Accessed Feb. 18, 2019 (Year: 2019).*
(Continued)

*Primary Examiner* — Alexandra M Moore
(74) *Attorney, Agent, or Firm* — Lempia Summerfield Katz LLC

(57) ABSTRACT

Disclosed are nickel alloys for exhaust system components having improved tensile strength, fatigue strength, oxidation resistance, and abrasion resistance at a high temperature condition. A nickel alloy for exhaust system components according to an embodiment is used for exhaust system components of a vehicle engine, the nickel alloy including: 0.01 to 0.2 wt % of C; 0.1 to 1.0 wt % of Si; 0.1 to 1.5 wt % of Mn; 8 to 24 wt % of Cr; 0.1 to 2.5 wt % of Nb; 0.1 to 4.0 wt % of Al; 0.01 to 1 wt % of Co; 0.01 to 5.0 wt % of Mo; 0.01 to 4 wt % of W; 0.1 to 1 wt % of Ta; 0.1 to 2.4 wt % of Ti; 4.0 to 11.0 wt % of Fe; a remainder being Ni; and inevitable impurities.

13 Claims, 3 Drawing Sheets

| item (wt%) | No. | Cr | Nb | Al | Co | Mo | W | Ta | Ti | Fe |
|---|---|---|---|---|---|---|---|---|---|---|
| conventional alloy | 713C | 13 | 1.8 | 6 | - | 4.5 | - | | 0.8 | - |
| Examples | #1 | 10.2 | 0.12 | 0.15 | 0.05 | 0.04 | 0.03 | 0.12 | 0.53 | 4.08 |
| | #2 | 23.6 | 2.47 | 3.96 | 0.96 | 4.96 | 3.93 | 0.96 | 2.17 | 10.92 |
| Comparative Examples | #1 | 7.8 | 0.49 | 0.32 | 0.47 | 0.06 | 2.38 | 0.37 | 0.62 | 4.52 |
| | #2 | 24.1 | 0.85 | 0.67 | 0.94 | 2.51 | 3.53 | 0.1 | 2.29 | 2.91 |
| | #3 | 12.2 | 0.08 | 1.56 | 0.63 | 3.21 | 0.62 | 0.43 | 0.95 | 5.39 |
| | #4 | 15.5 | 2.53 | 2.14 | 0.25 | 4.63 | 0.45 | 0.65 | 1.53 | 6.68 |
| | #5 | 22.5 | 0.28 | 0.07 | 0.19 | 3.64 | 1.34 | 0.75 | 2.13 | 8.51 |
| | #6 | 17.4 | 1.52 | 4.05 | 0.48 | 1.27 | 2.82 | 0.84 | 1.45 | 7.54 |
| | #7 | 23.6 | 2.34 | 0.59 | 0.008 | 0.95 | 3.75 | 0.46 | 0.84 | 10.66 |
| | #8 | 16.1 | 1.66 | 3.12 | 1.03 | 0.07 | 0.96 | 0.26 | 2.12 | 9.32 |
| | #9 | 17.9 | 0.92 | 1.82 | 0.27 | 0.008 | 0.15 | 0.19 | 0.93 | 5.57 |
| | #10 | 20.3 | 1.52 | 3.51 | 0.11 | 5.05 | 1.15 | 0.43 | 0.56 | 10.25 |
| | #11 | 16.6 | 0.11 | 0.55 | 0.43 | 0.06 | 0.009 | 0.65 | 0.91 | 4.38 |
| | #12 | 8.9 | 2.23 | 0.94 | 0.62 | 2.56 | 4.05 | 0.74 | 1.22 | 7.12 |
| | #13 | 15.7 | 2.46 | 1.88 | 0.75 | 3.21 | 2.13 | 0.09 | 1.08 | 9.36 |
| | #14 | 23.1 | 2.12 | 2.51 | 0.89 | 4.65 | 3.56 | 1.03 | 2.39 | 8.59 |
| | #15 | 18.1 | 0.15 | 3.66 | 0.46 | 3.67 | 0.07 | 0.43 | 0.09 | 4.84 |
| | #16 | 21.2 | 0.73 | 1.47 | 0.53 | 1.26 | 0.67 | 0.91 | 2.45 | 4.35 |
| | #17 | 12.5 | 1.81 | 0.24 | 0.85 | 0.97 | 1.54 | 0.62 | 0.49 | 3.96 |
| | #18 | 10.9 | 1.38 | 3.79 | 0.06 | 0.07 | 2.46 | 0.27 | 1.36 | 11.06 |

(56) References Cited

U.S. PATENT DOCUMENTS

| | | | | |
|---|---|---|---|---|
| 2002/0020384 | A1* | 2/2002 | Hoeg | C22C 19/05<br>123/188.3 |
| 2002/0195175 | A1 | 12/2002 | Ishida et al. | |
| 2006/0157171 | A1* | 7/2006 | Ueta | B21K 1/22<br>148/677 |
| 2010/0166594 | A1 | 7/2010 | Hirata et al. | |

FOREIGN PATENT DOCUMENTS

| | | | |
|---|---|---|---|
| JP | 2002363674 | | 12/2002 |
| JP | 2003253363 | A | 9/2003 |
| KR | 1020080053774 | A | 6/2008 |
| KR | 1020100075762 | | 7/2010 |

OTHER PUBLICATIONS

Korean Patent Office; Office Action; KR 10-2016-0131804; dated Aug. 10, 2017; 5pgs.

Notice of Allowance dated Jan. 9, 2018, Notice of Allowance in corresponding Korean Patent Application 10-2016-0131804, Jan. 9, 2018; 5 pages.

* cited by examiner

[FIG.1]

| item (wt%) | No. | Cr | Nb | Al | Co | Mo | W | Ta | Ti | Fe |
|---|---|---|---|---|---|---|---|---|---|---|
| conventional alloy | 713C | 13 | 1.8 | 6 | - | 4.5 | - | | 0.8 | - |
| Examples | #1 | 10.2 | 0.12 | 0.15 | 0.05 | 0.04 | 0.03 | 0.12 | 0.53 | 4.08 |
| | #2 | 23.6 | 2.47 | 3.96 | 0.96 | 4.96 | 3.93 | 0.96 | 2.17 | 10.92 |
| Comparative Examples | #1 | 7.8 | 0.49 | 0.32 | 0.47 | 0.06 | 2.38 | 0.37 | 0.62 | 4.52 |
| | #2 | 24.1 | 0.85 | 0.67 | 0.94 | 2.51 | 3.53 | 0.1 | 2.29 | 2.91 |
| | #3 | 12.2 | 0.08 | 1.56 | 0.63 | 3.21 | 0.62 | 0.43 | 0.95 | 5.39 |
| | #4 | 15.5 | 2.53 | 2.14 | 0.25 | 4.63 | 0.45 | 0.65 | 1.53 | 6.68 |
| | #5 | 22.5 | 0.28 | 0.07 | 0.19 | 3.64 | 1.34 | 0.75 | 2.13 | 8.51 |
| | #6 | 17.4 | 1.52 | 4.05 | 0.48 | 1.27 | 2.82 | 0.84 | 1.45 | 7.54 |
| | #7 | 23.6 | 2.34 | 0.59 | 0.008 | 0.95 | 3.75 | 0.46 | 0.84 | 10.66 |
| | #8 | 16.1 | 1.66 | 3.12 | 1.03 | 0.07 | 0.96 | 0.26 | 2.12 | 9.32 |
| | #9 | 17.9 | 0.92 | 1.82 | 0.27 | 0.008 | 0.15 | 0.19 | 0.93 | 5.57 |
| | #10 | 20.3 | 1.52 | 3.51 | 0.11 | 5.05 | 1.15 | 0.43 | 0.56 | 10.25 |
| | #11 | 16.6 | 0.11 | 0.55 | 0.43 | 0.06 | 0.009 | 0.65 | 0.91 | 4.38 |
| | #12 | 8.9 | 2.23 | 0.94 | 0.62 | 2.56 | 4.05 | 0.74 | 1.22 | 7.12 |
| | #13 | 15.7 | 2.46 | 1.88 | 0.75 | 3.21 | 2.13 | 0.09 | 1.08 | 9.36 |
| | #14 | 23.1 | 2.12 | 2.51 | 0.89 | 4.65 | 3.56 | 1.03 | 2.39 | 8.59 |
| | #15 | 18.1 | 0.15 | 3.66 | 0.46 | 3.67 | 0.07 | 0.43 | 0.09 | 4.84 |
| | #16 | 21.2 | 0.73 | 1.47 | 0.53 | 1.26 | 0.67 | 0.91 | 2.45 | 4.35 |
| | #17 | 12.5 | 1.81 | 0.24 | 0.85 | 0.97 | 1.54 | 0.62 | 0.49 | 3.96 |
| | #18 | 10.9 | 1.38 | 3.79 | 0.06 | 0.07 | 2.46 | 0.27 | 1.36 | 11.06 |

[FIG.2]

| item (wt%) | No. | tensile strength (20°C) MPa | tensile strength (850°C) MPa | elongation A5 (850°C) % | fatigue strength (850°C, $10^7$ times) MPa | oxidation weight gain (850°C/100h) $g/m^2$ | high-temperature oxidation weight gain (850°C/2km) mg |
|---|---|---|---|---|---|---|---|
| conventional alloy | 713C | 900 | 805 | 15 | 280 | 2.1 | 10.1 |
| Examples | #1 | 1080 | 972 | 17 | 350 | 0.2 | 1.5 |
| | #2 | 1160 | 1044 | 13 | 363 | 0.7 | 1.9 |
| Comparative Examples | #1 | 890 | 805 | 13 | 285 | 3.1 | 4.3 |
| | #2 | 1020 | 920 | 12 | 340 | 1.3 | 6.1 |
| | #3 | 915 | 830 | 10 | 275 | 2.5 | 2.4 |
| | #4 | 930 | 835 | 6 | 310 | 3.5 | 8.9 |
| | #5 | 855 | 770 | 13 | 280 | 1.4 | 9.6 |
| | #6 | 935 | 850 | 9 | 320 | 0.9 | 2.2 |
| | #7 | 945 | 850 | 11 | 325 | 2.8 | 5.5 |
| | #8 | 890 | 810 | 12 | 290 | 1.6 | 3.8 |
| | #9 | 860 | 790 | 15 | 285 | 1.9 | 2.4 |
| | #10 | 1010 | 940 | 6 | 335 | 3.2 | 6.7 |
| | #11 | 925 | 845 | 12 | 305 | 1.5 | 8.1 |
| | #12 | 835 | 755 | 8 | 260 | 3.3 | 4.2 |
| | #13 | 890 | 800 | 12 | 280 | 1.4 | 6.3 |
| | #14 | 920 | 835 | 8 | 315 | 3.1 | 2.6 |
| | #15 | 915 | 825 | 12 | 280 | 1.7 | 4.5 |
| | #16 | 920 | 840 | 13 | 320 | 3.1 | 5.2 |
| | #17 | 935 | 845 | 9 | 325 | 3.6 | 3.8 |
| | #18 | 840 | 755 | 11 | 260 | 1.5 | 5.6 |

[FIG.3]
2016.05.23.14.52.31
TCNI8:AL, C, CO, CR, FE, MN, MO, NB, NI, SI, TA, TI, W
P=1.01325E5, W(C)=5E-4, W(SI)=E3-3, W(MN)=5E-3, W(CR)=0.16,
W(CO)=5E-3, W(FE)=8E-2, W(NB)=9E-3, W(MO)=4E-2,
W(AL)=1.3E-2, W(TI)=2E-2, W(W)=2E-2, W(TA)=5E-3, N=1
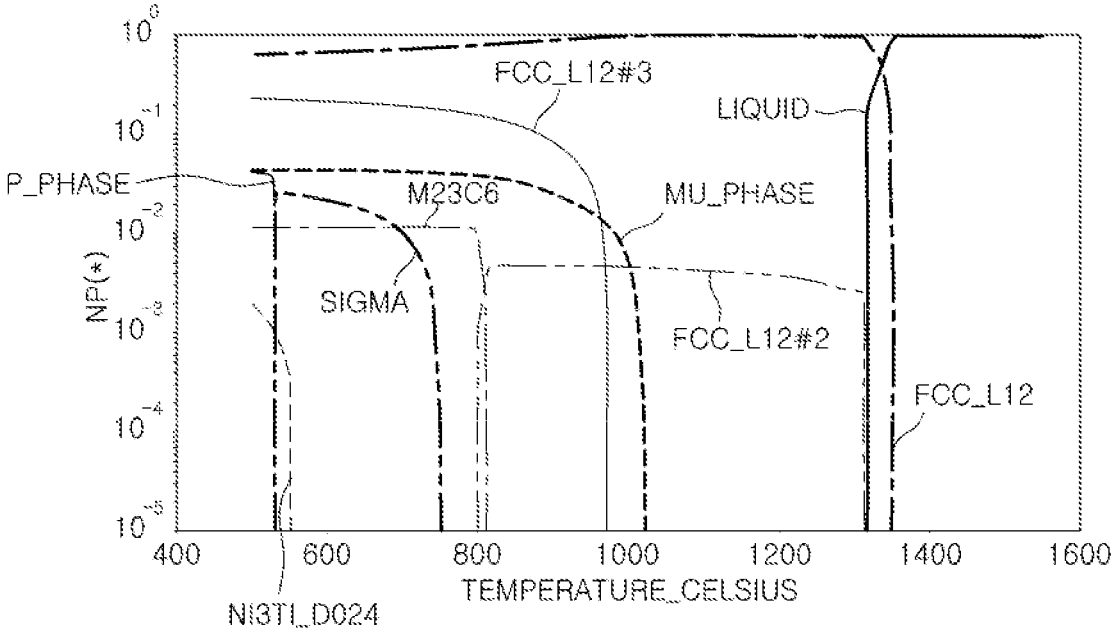

NICKEL ALLOYS FOR EXHAUST SYSTEM COMPONENTS

CROSS REFERENCE TO RELATED APPLICATION

The present application claims priority to Korean Patent Application No. 10-2016-0131804, filed Oct. 12, 2016, the entire amounts of which is incorporated herein for all purposes by this reference.

BACKGROUND

1. Field

The present disclosure relates to nickel alloys for exhaust system components. More particularly, the present disclosure relates to nickel alloys for exhaust system components, the nickel alloys having improved tensile strength, fatigue strength, oxidation resistance, and abrasion resistance at high temperature conditions.

2. Description of the Related Art

Due to the limitation of fossil fuel reserves, and the rapid increase and change in international oil prices, there has been increasing interest in improving the gas mileage of a vehicle.

Accordingly, techniques of improving the gas mileage of a vehicle have been studied in a variety of ways. One of these is a technique of reducing the weight of the vehicle.

The technique of reducing the weight of the vehicle has been studied in a variety of fields. In particular, a technique of reducing a size of a vehicle engine while increasing an output of the vehicle engine has been studied and employed.

However, the downsized vehicle engine with the increased output is problematic in that a temperature of exhaust gas is increased, thereby causing a problem in terms of durability of components composing an exhaust system of the vehicle engine.

Thus, a technique of improving desired physical properties by controlling elements of various steel types such as spheroidal graphite cast iron and stainless steel have been applied to the components composing the exhaust system of the vehicle engine.

The foregoing is intended merely to aid in the understanding of the background of the present disclosure, and is not intended to mean that the present disclosure falls within the purview of the related art that is already known to those skilled in the art.

BRIEF SUMMARY

Accordingly, the present disclosure has been made keeping in mind the above problems occurring in the related art, and the present disclosure is intended to propose a nickel alloy for exhaust system components, the nickel alloy having excellent tensile strength, fatigue strength, oxidation resistance and abrasion resistance by optimizing alloying elements and their amounts to produce a stable Ta—Ti compound and a complex carbide in a structure thereof.

In order to achieve the above object, according to one aspect, there is provided a nickel alloy for an exhaust system components, the nickel alloy including: 0.01 to 0.2 wt % of C; 0.1 to 1.0 wt % of Si; 0.1 to 1.5 wt % of Mn; 8 to 24 wt % of Cr; 0.1 to 2.5 wt % of Nb; 0.1 to 4.0 wt % of Al; 0.01 to 1 wt % of Co; 0.01 to 5.0 wt % of Mo; 0.01 to 4 wt % of W; 0.1 to 1 wt % of Ta; 0.1 to 2.4 wt % of Ti; 4.0 to 11.0 wt % of Fe; a remainder being Ni; and inevitable impurities.

The nickel alloy may contain a Ta—Ti based compound and a complex carbide of $(Cr, Mo)_{23}C_6$.

The nickel alloy may have a tensile strength of 950 Mpa (megapascal) or more at a high temperature (e.g., 850° C.) higher than room temperature (e.g., 20° C.).

The nickel alloy may have a fatigue strength of 350 Mpa or more at a high temperature (e.g., 850° C.) higher than room temperature (e.g., 20° C.).

The nickel alloy may have an oxidation weight gain of 0.7 $g/m^2$ or less at a high temperature (e.g., 850° C.) higher than room temperature (e.g., 20° C.).

The nickel alloy may have an abrasion amount of 2.0 mg or less at a high temperature (e.g., 850° C.) higher than room temperature (e.g., 20° C.).

The nickel alloy may have a tensile strength of 1050 MPa or more at room temperature, and may have an elongation A5 of 13% or more at a high temperature (e.g., 850° C.) higher than room temperature (e.g., 20° C.).

Further, a nickel alloy for exhaust system components according to an embodiment is used for exhaust system components of a vehicle engine and contains a Ta—Ti based compound and a complex carbide of $(Cr, Mo)_{23}C_6$.

According to an embodiment, it is possible to produce a desired level of a Ta—Ti based compound and complex carbide in the structure thereof by optimizing the amount of main alloying elements. Thus, a nickel alloy having excellent high-temperature properties satisfying a tensile strength of 950 MPa or more, a fatigue strength of 350 Mpa or more, an oxidation weight gain of 0.7 $g/m^2$ or less, and an abrasion amount of 2.0 mg or less can be obtained.

BRIEF DESCRIPTION OF THE DRAWINGS

The above and other objects, features, and other advantages of the present disclosure will be more clearly understood from the following detailed description when taken in conjunction with the accompanying drawings, in which:

FIG. 1 is a table showing elements of Examples and Comparative Examples.

FIG. 2 is a table showing physical properties and performance of Examples and Comparative Examples.

FIG. 3 is a graph showing a result of calculating a phase transformation of a nickel alloy as a function of temperature according to an embodiment.

DETAILED DESCRIPTION

Hereinbelow, exemplary embodiments will be described in detail with reference to the accompanying drawings. However, the present disclosure may be embodied in many different forms and should not be construed as limited to the exemplary embodiments set forth herein. Rather, these exemplary embodiments are provided so that this disclosure will be thorough and complete, and will fully convey the scope of the present disclosure to those skilled in the art.

FIG. 1 is a table showing elements of Examples and Comparative Examples, FIG. 2 is a table showing physical properties and performance of Examples and Comparative Examples, and FIG. 3 is a graph showing a result of calculating a phase transformation of a nickel alloy as a function of temperature according to an embodiment.

A nickel alloy for exhaust system components is a nickel alloy employed in an exhaust system of a vehicle engine, and having improved tensile strength, fatigue strength, oxidation resistance, and abrasion resistance at a high temperature condition by optimizing the amount of main alloying elements. More particularly, the present disclosure is directed to a nickel alloy including: 0.01 to 0.2 wt % of C; 0.1 to 1.0 wt % of Si; 0.1-1.5 wt % of Mn; 8 to 24 wt % of Cr; 0.1 to 2.5 wt % of Nb; 0.1 to 4.0 wt % of Al; 0.01 to 1 wt % of Co; 0.01 to 5.0 wt % of Mo; 0.01 to 4 wt % of W; 0.1 to 1 wt % of Ta; 0.1 to 2.4 wt % of Ti; 4.0 to 11.0 wt % of Fe; a remainder being Ni; and inevitable impurities.

The reason why alloying elements and composition ranges thereof are limited is as follows. Hereinafter, unless otherwise specified, percentages % represented with respect to the composition ranges refers to wt %.

Carbon (C): 0.01 to 0.2%

Carbon (C) is an element that serves to increase strength and hardness by forming a complex carbide such as $(Cr, Mo)_{23}C_6$, NbC, etc. Further, carbon (C) improves oxidation resistance due to grain boundary sensitization at a temperature of 450 to 850° C.

If the carbon (C) amount is less than 0.01%, carbide formation and strength are reduced. On the other hand, if the carbon (C) amount exceeds 0.2%, sensitivity is excessively increased. Accordingly, the amount of carbon (C) is may be limited to a range of 0.01 to 0.2%.

Silicon (Si): 0.1 to 1.0%

Silicon (Si) is an element that serves as a deoxidizer and controls elongation. In particular, Silicon (Si) increases oxidation resistance, stress corrosion cracking (SCC) resistance, and castability.

If the silicon (Si) amount is less than 0.1%, oxidation resistance and castability are reduced. On the other hand, if the silicon (Si) amount exceeds 1.0%, ductility and weldability are deteriorated. Accordingly, the silicon (Si) amount may be limited to a range of 0.1 to 1.0%.

Manganese (Mn): 0.1 to 1.5%

Manganese (Mn) is an element that serves to improve strength. In particular, Manganese (Mn) increases hardenability, nitrogen (N) solubility and yield strength and reduces cooling rate.

If the Manganese (Mn) amount is less than 0.1%, hardenability is reduced. On the other hand, if the Manganese (Mn) amount exceeds 1.5%, the effects of other elements are reduced. Accordingly, the Manganese (Mn) amount may be limited to a range of 0.1 to 1.5%.

Chromium (Cr): 8.0 to 24.0%

Chromium (Cr) is an element that serves as a solid-solution strengthening agent and forms carbides. Further, Chromium (Cr) increases strength and oxidation resistance, suppresses Cl oxidation and the formation of γ phase, and is an austenite stabilizing element along with Ni and Mn.

If the chromium (Cr) amount is less than 8.0%, oxidation resistance and structural stability are reduced. On the other hand, if the chromium (Cr) amount exceeds 24.0%, the effects of other elements are reduced. Accordingly, the chromium (Cr) amount may be limited to a range of 8.0 to 24.0%.

Niobium (Nb): 0.1 to 2.5%

Niobium (Nb) is an element that serves as a solid-solution strengthening agent and influences high-temperature strength, and also forms carbides. In particular, Niobium (Nb) suppresses the formation of γ phase ($Ni_3Nb$) that influences low-temperature strength and weldability, and the formation of σ/δ phase that influences brittleness and crack point along with Ni. Further, Niobium (Nb) forms γ' phase and ferrite that have high mechanical properties and suppresses the formation of γ phase and laves phase. Further, Niobium (Nb) improves heat resistance when the Niobium (Nb) amount is high.

If the Niobium (Nb) amount is less than 0.1%, high-temperature strength and weldability are reduced. On the other hand, if the Niobium (Nb) amount exceeds 2.5%, intermetallic phase that reduces physical properties is formed. Accordingly, the Niobium (Nb) amount may be limited to a range of 0.1 to 2.5%.

Al: 0.1 to 4.0%

Aluminum (Al) is an element that serves as a solid-solution strengthening agent. In particular, Aluminum (Al) increases oxidation resistance and enables grain uniformity and grain refinement. Further, Aluminum (Al) forms γ' phase and γ + γ'phase that have high mechanical properties.

If the aluminum (Al) amount is less than 0.1%, high-temperature strength and grain uniformity are reduced. On the other hand, if the aluminum (Al) amount exceeds 4.0%, the formation of carbides is reduced. Accordingly, the aluminum (Al) amount may be limited to a range of 0.1 to 4.0%.

Cobalt (Co): 0.01 to 1.0%

Cobalt (Co) is an element that serves to suppress excessive grain growth at high temperature. In particular, Cobalt (Co) increases creep strength and tempering property.

If the cobalt (Co) amount is less than 0.01%, the effect of preventing excessive grain growth at high temperature is insufficient, and creep strength is reduced. On the other hand, if the cobalt (Co) amount exceeds 1.0%, the effects of other elements are reduced. Accordingly, the cobalt (Co) amount may be limited to a range of 0.01 to 1.0%.

Molybdenum (Mo): 0.01 to 5.0%

Molybdenum (Mo) is an element that serves as a solid-solution strengthening agent. In particular, Molybdenum (Mo) forms carbides, inhibits oxidation of Cl, and produces $Ni_3Mo$, thereby improving mechanical properties, pitting resistance, and crack resistance.

Molybdenum (Mo) suppresses the formation of γ phase and increases creep strength. Further, Molybdenum (Mo) is required to control the formation of μphase that reduces creep strength, room-temperature ductility, toughness and oxidation resistance.

If the molybdenum (Mo) amount is less than 0.01%, the formation of carbides is reduced and the effect of improving strength due to the formation of carbides is reduced. On the other hand, if the molybdenum (Mo) amount) exceeds 5.0%, an intermetallic phase that reduces physical properties is produced. Accordingly, the molybdenum (Mo) amount may be limited to a range of 0.01 to 5.0%.

Tungsten (W): 0.01 to 4.0%

Tungsten (W) is an element that serves as a solid-solution strengthening agent. In particular, Tungsten (W) forms carbides to suppress grain boundary sliding, suppresses oxidation of Cl, suppresses excessive grain growth, and participates in the formation of γ phase and μphase.

If the tungsten (W) amount is less than 0.01%, strength is reduced and excessive grain growth occurs. On the other hand, if the tungsten (W) amount exceeds 4.0%, intermetallic phase that reduces physical properties is formed. Accordingly, the tungsten (W) amount may be limited to a range of 0.01 to 4.0%.

Tantalum (Ta): 0.1 to 1.0%

Tantalum (Ta) is an element that provides high-temperature and low-temperature oxidation resistance. In particular, Tantalum (Ta) increases creep strength by solid solution strengthening. However, Tantalum (Ta) is an expensive rare earth element.

If the tantalum (Ta) amount is less than 0.1%, oxidation resistance and strength are deteriorated. On the other hand, if the tantalum (Ta) amount exceeds 1.0%, costs are increased.

Titanium (Ti): 0.1 to 2.4%

Titanium (Ti) an element that serves as a solid-solution strengthening agent. In particular, Titanium (Ti) forms carbides to suppress grain boundary sliding and increases high-temperature strength. Further, Titanium (Ti) forms γ+γ' phase having excellent mechanical properties, increases grain refinement and sensitization resistance, and creep strength, and prevents nitrification.

If the titanium (Ti) amount is less than 0.1%, strength and sensitization resistance are reduced. On the other hand, if the titanium (Ti) amount exceeds 2.4%, it is difficult to control nitrification.

Fe: 4.0 to 11.0%

Iron (Fe) is an element that serves as a solid-solution strengthening agent. In particular, Iron (Fe) forms austenitic γ phase along with Cr and Ni. However, Iron (Fe) is vulnerable to moisture oxidation due to high oxygen affinity.

If the iron (Fe) amount is less than 4.0%, the effect of solid-solution strengthening and the formation of γ phase are reduced. On the other hand, if the iron (Fe) amount exceeds 11.0%, oxidation resistance with respect to moisture is deteriorated.

The remainders except the above-mentioned elements are Ni and inevitably contained impurities.

EXAMPLES AND COMPARATIVE EXAMPLES

Hereinafter, the present disclosure will be described with reference to Comparative Examples and Examples.

As shown in FIG. 1, specimens were obtained by vacuum casting using molten steel that was produced while changing the amounts of each element. Each of specimens thus obtained was subjected to a heat treatment for 1 to 2 hours at 920 to 1250° C., and then air cooling to be prepared. However, in this experiment, C, Si, and Mn, which were considered not to directly influence the desired effect of the present disclosure, were fixed to the amount ranges specified in the present disclosure, and the amount of other elements were changed. Accordingly, although the amount of C, Si and Mn are not shown in FIG. 1, Comparative Examples 1 to 18 and Examples 1 to 2 were carried out under the same conditions in a range of 0.01 to 0.2% of C, 0.1 to 1.0% of Si, and 0.1 to 1.5% of Mn.

Next, experimental examples for confirming physical properties of a conventional alloy treated by the above-mentioned process and specimens according to Comparative Examples and Examples will be described.

The conventional alloy and each of specimens according to Comparative Examples and Examples were subjected to tests to measure the room-temperature tensile strength (20° C.), the high-temperature tensile strength (850° C.), the elongation A5 (850° C.), the fatigue strength (850° C., $10^7$ times), the oxidation weight gain (850° C., 100 h), and high-temperature abrasion amount (850° C., 2 Km) thereof, and measurement results obtained are shown in FIG. 2.

The room-temperature tensile strength and the high-temperature tensile strength for each of specimens were measured by a 20-ton Universal Testing Machine according to KS B 0802, the elongation A5 was measured at 850° C., and the fatigue strength was measured by a rotational bending fatigue test at 850° C. according to KS B ISO 1143.

Further, to evaluate oxidation weight gain, each of specimens according to Comparative Examples and Examples was prepared, weight of each of specimens were measured, and then each of specimens was maintained at 850° C. for 100 hours. Here, each of specimens was exposed to $N_2$ (20%), $O_2$ (10%), and $H_2O$. After 100 hours passed, the weight of each of specimens was measured, and then the difference between the weight before treatment and the weight after treatment for each of specimens was measured.

Further, the high-temperature abrasion amount was measured by a high-temperature friction and wear test (pin on disc). Each of specimens was moved at a speed of 0.1 m/s for a distance of 2 km with a load of 20 N. at 850° C., and then the abrasion amount of each of specimens was measured.

As indicated in FIG. 2, the conventional alloy 713C did not contain Co, W, Ta, Ti, and Fe, and the Al amount did not satisfy the amount range specified in the present disclosure. Thus, the conventional alloy 713C did not satisfy the requirements of the present disclosure in terms of room-temperature tensile strength, high-temperature tensile strength, fatigue strength, oxidation weight gain, and high-temperature abrasion amount.

Examples 1 and 2 satisfying the amount of the alloying elements specified in the present disclosure satisfied a tensile strength of 950 Mpa (megapascal) or more at high temperature (850° C.) higher than room temperature (e.g., 20° C.), a fatigue strength of 350 Mpa or more, an oxidation weight gain of 0.7 g/$m^2$ or less, and a high-temperature abrasion amount of 2.0 mg or less. Further, Examples 1 and 2 satisfied a tensile strength of 1050 Mpa or more at room temperature (e.g., 20° C.) and an elongation A5 of 13% or more.

On the other hand, Comparative Examples 1 to 18 do not satisfy the amount of the alloying elements specified in the present disclosure. Accordingly, it can be seen that the room-temperature tensile strength, the high-temperature tensile strength, the elongation A5, the fatigue strength, the oxidation weight gain, and the high-temperature abrasion amount are partially improved when compared with the conventional alloy 713C. However, Comparative Examples 1 to 18 did not satisfy all the requirements of the present disclosure.

In particular, in Comparative Example 5, the Al amount was less than the requirements of the present disclosure, in Comparative Example 9, the Mo amount was less than the requirements of the present disclosure. Accordingly, Comparative Examples 5 and 9 satisfied the requirements of the present disclosure in terms of elongation A5. However, it was found that Comparative Examples 5 and 9 did not satisfy the requirements of the present disclosure in terms of room-temperature tensile strength, high-temperature tensile strength, fatigue strength, oxidation weight gain, and high-temperature abrasion amount.

Meanwhile, FIG. 3 is a graph showing the result of calculating a phase transformation according to temperature with respect to a nickel alloy according to an embodiment. When satisfying alloy composition, a phase (SIGMA; σ) that adversely affects elongation and high-temperature brittleness is less formed. On the other hand, phases, such as a Ta—Ti based compound and a complex carbide, that favorably affects physical properties are formed. Thus, it is expected that high-temperature tensile strength and fatigue strength can be increased and high-temperature oxidation weight gain can be reduced.

As indicated in FIG. 3, FCC_L12 refers to matrix γ, FCC_L12#2 and FCC_L12#3 refer to MCC refers to γ'/γ", Mu refers to μ, M23C6 refers to a complex carbide such as $(Cr,Mo)_{23}C_6$, and Ni3Ti refers to a Ta—Ti based compound such as $(NiTa)_3(AlTi)$.

Although embodiments have been described for illustrative purposes, those skilled in the art will appreciate that various modifications, additions, and substitutions are possible, without departing from the scope and spirit of the disclosure as disclosed in the accompanying claims. It is therefore intended that the foregoing description be regarded as illustrative rather than limiting, and that it be understood that all equivalents and/or combinations of embodiments are intended to be included in this description.

It is to be understood that the elements and features recited in the appended claims may be combined in different ways to produce new claims that likewise fall within the scope of the present disclosure. Thus, whereas the dependent claims appended below depend from only a single independent or dependent claim, it is to be understood that these dependent claims may, alternatively, be made to depend in the alternative from any preceding or following claim, whether independent or dependent, and that such new combinations are to be understood as forming a part of the present specification.

What is claimed is:

1. A nickel alloy for exhaust system components, wherein the nickel alloy is used for exhaust system components of a vehicle engine, the nickel alloy comprising:

0.01-0.2 wt % C;
0.1-1.0 wt % Si;
0.1-1.5 wt % Mn;
8-24 wt % Cr;
0.1-2.5 wt % Nb;
0.1-4.0 wt % Al;
0.01-1 wt % Co;
0.01-5.0 wt % Mo;
0.01-4 wt % W;
0.1-1 wt % Ta;
0.1-2.4 wt % Ti;
4.0-11.0 wt % Fe; and
a remainder comprising Ni and any impurities,
wherein the nickel alloy has an oxidation weight gain of 0.7 $g/m^2$ or less at a temperature higher than 20° C., and
wherein the nickel alloy has an abrasion amount of 2.0 mg or less at a temperature higher than 20° C.

2. The nickel alloy of claim 1, wherein the nickel alloy contains a Ta—Ti based compound and a complex carbide of $(Cr,Mo)_{23}C_6$.

3. The nickel alloy of claim 2, wherein the nickel alloy has a tensile strength of 950 MPa or more at a temperature higher than 20° C.

4. The nickel alloy of claim 3, wherein the nickel alloy has a fatigue strength of 350 MPa or more at the temperature higher than 20° C.

5. The nickel alloy of claim 1, wherein the nickel alloy has a tensile strength of 950 MPa or more at a temperature higher than 20° C.

6. The nickel alloy of claim 5, wherein the nickel alloy has a fatigue strength of 350 MPa or more at the temperature higher than 20° C.

7. The nickel alloy of claim 1, wherein the nickel alloy has a fatigue strength of 350 MPa or more at a temperature higher than 20° C.

8. The nickel alloy of claim 1, wherein the nickel alloy has a tensile strength of 1050 MPa or more at 20° C., and has an elongation A5 of 13% or more at a temperature higher than 20° C.

9. The nickel alloy of claim 1, wherein the nickel alloy has a tensile strength of 950 MPa or more at a temperature of 850° C.

10. The nickel alloy of claim 9, wherein the nickel alloy has a fatigue strength of 350 MPa or more at the temperature of 850° C.

11. The nickel alloy of claim 1, wherein the nickel alloy has a fatigue strength of 350 MPa or more at a temperature of 850° C.

12. The nickel alloy of claim 1, wherein the temperature is 850° C.

13. A nickel alloy for exhaust system components, wherein the nickel alloy is used for exhaust system components of a vehicle engine, the nickel alloy consisting of:

0.01-0.2 wt % C;
0.1-1.0 wt % Si;
0.1-1.5 wt % Mn;
8-24 wt % Cr;
0.1-2.5 wt % Nb;
0.1-4.0 wt % Al;
0.01-1 wt % Co;
0.01-5.0 wt % Mo;
0.01-4 wt % W;
0.1-1 wt % Ta;
0.1-2.4 wt % Ti;
4.0-11.0 wt % Fe; and
a remainder consisting of Ni and any impurities,
wherein the nickel alloy has an oxidation weight gain of 0.7 $g/m^2$ or less at a temperature higher than 20° C., and
wherein the nickel alloy has an abrasion amount of 2.0 mg or less at a temperature higher than 20° C.

* * * * *